US009264791B1

(12) United States Patent
Polivy

(10) Patent No.: US 9,264,791 B1
(45) Date of Patent: Feb. 16, 2016

(54) PORTABLE AUDIO SPEAKER SYSTEM THAT ATTACHES TO CLOTHING OR OTHER STRUCTURES VIA MAGNET

(71) Applicant: Ari W. Polivy, Canton, MA (US)

(72) Inventor: Ari W. Polivy, Canton, MA (US)

( * ) Notice: Subject to any disclaimer, the term of this patent is extended or adjusted under 35 U.S.C. 154(b) by 143 days.

(21) Appl. No.: 13/790,095

(22) Filed: Mar. 8, 2013

Related U.S. Application Data

(60) Provisional application No. 61/616,495, filed on Mar. 28, 2012.

(51) Int. Cl.
*H04R 1/02* (2006.01)

(52) U.S. Cl.
CPC ..... *H04R 1/025* (2013.01)

(58) Field of Classification Search
CPC ..... H04R 1/02; H04R 2499/11; H04R 1/028; H04R 29/00
USPC ..... 381/56, 334
See application file for complete search history.

(56) References Cited

U.S. PATENT DOCUMENTS

| | | | | |
|---|---|---|---|---|
| 4,322,585 | A | 3/1982 | Liautaud | 179/157 |
| 7,013,492 | B2 | 3/2006 | Hugh et al. | 2/243.1 |
| 7,587,227 | B2 | 9/2009 | Cheung et al. | 455/575.6 |
| 8,189,843 | B2 | 5/2012 | Harper | 381/374 |
| 2008/0267378 | A1* | 10/2008 | Janse et al. | 379/202.01 |
| 2008/0287166 | A1* | 11/2008 | Lin | 455/569.1 |
| 2013/0331153 | A1 | 12/2013 | Krimstock | 455/569.1 |

* cited by examiner

*Primary Examiner* — Rasha Al Aubaidi
(74) *Attorney, Agent, or Firm* — Sunstein Kann Murphy & Timbers LLP

(57) ABSTRACT

A portable audio speaker system includes at least one speaker/housing assembly, each speaker/housing assembly including a speaker disposed inside of a housing, wherein the housing includes at least one of a magnet or a metal plate allowing the speaker/housing assembly to be attached to an item magnetically. The portable audio speaker system may include wired or wireless communication connection to the speaker/housing assembly, such as from a portable music player or other audio source.

16 Claims, 4 Drawing Sheets

PORTABLE AUDIO SPEAKER SYSTEM THAT ATTACHES TO CLOTHING OR OTHER STRUCTURES VIA MAGNET

CROSS-REFERENCE TO RELATED APPLICATION(S)

This patent application is a non-provisional of, and therefore claims the benefit of, U.S. Provisional Patent Application No. 61/616,495 filed on Mar. 28, 2012, which is hereby incorporated herein by reference in its entirety.

FIELD OF THE INVENTION

The present invention relates generally to portable audio devices and, more particularly, to small portable audio speakers that can be attached to clothing or other structures by magnets.

BACKGROUND OF THE INVENTION

Portable Audio Devices, such as MP3 Players, Smartphones, etc., are often used with headphones in a variety of situations. Unfortunately, headphones can be unsafe in some of these situations and there are situations in which headphones are simply not permitted. For example the wearing of headphones can reduce the ability of a person to hear extraneous sounds and therefore the person may not recognize dangerous or important situations (e.g., an oncoming vehicle, an approaching attacker, emergency instructions, etc.)

Portable speaker systems exist that are not worn in or on the ears. Some of these portable speaker systems can be attached to items such as clothing. For example the speaker by Safe Sound Sports can be clipped onto a shirt, while the speaker described in U.S. Pat. No. 4,322,585 can be pinned to a shirt. However, such speakers are inconvenient because they can damage the clothing and can limit other uses of the speaker. In addition, portable speaker systems which merely clip to the shirt are limited to edges that can hold the clip, which offers little support for the speaker. The speakers are fastened to the shirt but have a great deal of movement to pull at and annoy the user.

Portable audio devices have truly changed the way that users are able to enjoy music. With the size of audio speakers shrinking, a speaker system will soon have no noticeable weight or any restrictions on the free movement of the user.

SUMMARY OF EXEMPLARY EMBODIMENTS

In one embodiment there is provided a portable audio speaker system comprising at least one speaker/housing assembly, each speaker/housing assembly including a speaker disposed inside of a housing, wherein the housing includes a magnet separate from any magnet of the speaker, the magnet allowing the housing to be attached to an item.

In various alternative embodiments, the magnet may be inside of the housing or may be outside of the housing. In certain embodiments, a second magnet may be included to attach the housing to the item when the item is positioned between the housing magnet and the second magnet. Alternatively, in other embodiments, a metal plate may be included to attach the housing to the item when the item is positioned between the housing magnet and the metal plate. Each speaker/housing assembly may include multiple holes and/or a mesh screen to allow sound from the speaker to be heard more clearly. Each speaker/housing assembly may include at least one structure configured to directly target sound from the speaker to a user's ear. Systems may include a plurality of speaker/housing assemblies, such as, without limitation, two, four, five, or six speaker/housing assemblies. Systems may also include wiring or a wireless communication interface (e.g., Bluetooth) to allow audio signals to be transmitted to the speaker/housing assembly or assemblies.

In another embodiment there is provided a portable audio speaker system comprising at least one speaker/housing assembly, each speaker/housing assembly including a speaker disposed inside of a housing, wherein the housing includes a metal plate allowing the housing to be attached to an item using a magnet separate from the housing.

In various alternative embodiments, the metal plate may be inside of the housing or may be outside of the housing. In certain embodiments, a magnet may be included to attach the housing to the item when the item is positioned between the housing and the magnet. Each speaker/housing assembly may include multiple holes and/or a mesh screen to allow sound from the speaker to be heard more clearly. Each speaker/housing assembly may include at least one structure configured to directly target sound from the speaker to a user's ear. Systems may include a plurality of speaker/housing assemblies, such as, without limitation, two, four, five, or six speaker/housing assemblies. Systems may also include wiring or a wireless communication interface (e.g., Bluetooth) to allow audio signals to be transmitted to the speaker/housing assembly or assemblies.

Additional embodiments may be disclosed and claimed.

BRIEF DESCRIPTION OF THE DRAWINGS

The foregoing and advantages of the invention will be appreciated more fully from the following further description thereof with reference to the accompanying drawings wherein.

Figure 1:
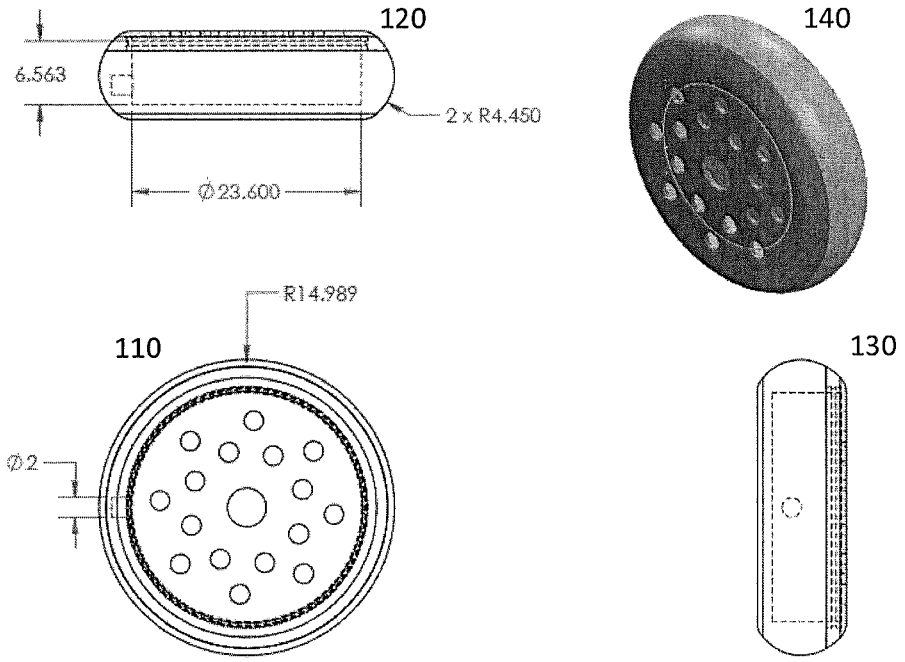
FIG. 1 is a schematic diagram showing various views of an assembled speaker/housing assembly, in accordance with an exemplary embodiment of the present invention.

It should be noted that the foregoing figures and the elements depicted therein are not necessarily drawn to consistent scale or to any scale, unless specifically stated in figure. Detail elements are highlighted alphabetically.

DETAILED DESCRIPTION OF SPECIFIC EMBODIMENTS

Embodiments combine the shrinking technological advancements in portable audio speakers with an extremely lightweight, simplistic housing and a very lightweight yet strong attachment method to create a unique device. The unique device has a set of characteristics that allow it to provide safety and freedom of movement not seen in any device currently today.

The portable audio device includes a small speaker and the accompanying housing designed to be lightweight enough for the users movement's not to be affected or for the user to even notice the speaker. Many people currently use portable MP3 players while exercising and engaging in other various activities, and desire a portable audio system with no effects on kinesiology at all. In addition, it is simply dangerous to wear headphones in many areas because headphones obstruct hearing of important noises, such as oncoming traffic while running, or emergency services sirens while driving. These audio devices address this safety concern while avoiding the insolvencies that other portable audio devices do not.

Many of these embodiments incorporate specific features, however there are many characteristics that are consistent throughout the embodiments, which are: the minute size of the speaker, and the safety provided by having an external speaker instead of an over or inside the ear head phone that blocks out other sounds.

In a first exemplary embodiment of this portable audio device, the speakers are attached with two small magnets. One of these magnets is located inside the bottom of the housing and is not visible from the outside of the housing. This magnet attaches to the complementary magnet that is detachable from the housing and holds the speaker to a piece of clothing or thin film that is not magnetic. This embodiment can also be utilized without the second detachable magnet, which would be the case if the user decided to attach the portable audio device to a refrigerator or any other metallic structure, such the poles of an awning or tent. This embodiment does not rely an adhesive or other addition to the housing (e.g., a press fitting) to keep the inner magnet in place which generally would be required if the magnet were placed on the outside.

A second exemplary embodiment of this portable audio device places the magnet outside of the housing in order to achieve as strong of a magnetic bond as possible through eliminating the gap that the housing causes between the magnets in the first embodiment. The magnet may be fixed inside a recess in the bottom of the housing and secured with other means such as an adhesive along its circumference.

In a third exemplary embodiment, there is only one magnet, which is detachable from the housing. The housing includes a small metal disk located either within or centered on the bottom of the housing. Basically, a small metal disk replaces the location of the housing magnet from the first and second embodiments. This disk is not a magnet itself but rather acts as a paramagnetic when the detachable magnet is brought within a close range. This embodiment requires the second magnet to be placed on the other side of an item such as clothing or a thin film in order for this portable audio device to be attached to a non-magnetic item (in some cases, the portable audio device may be attached to an item that itself is magnetic, such as a magnetic board).

FIG. 1 is a schematic diagram showing various views of an assembled speaker/housing assembly, in accordance with an exemplary embodiment of the present invention. Shown here are a front view 110, a top view 120, a side view 130, and an isometric view 140

Figure 2:
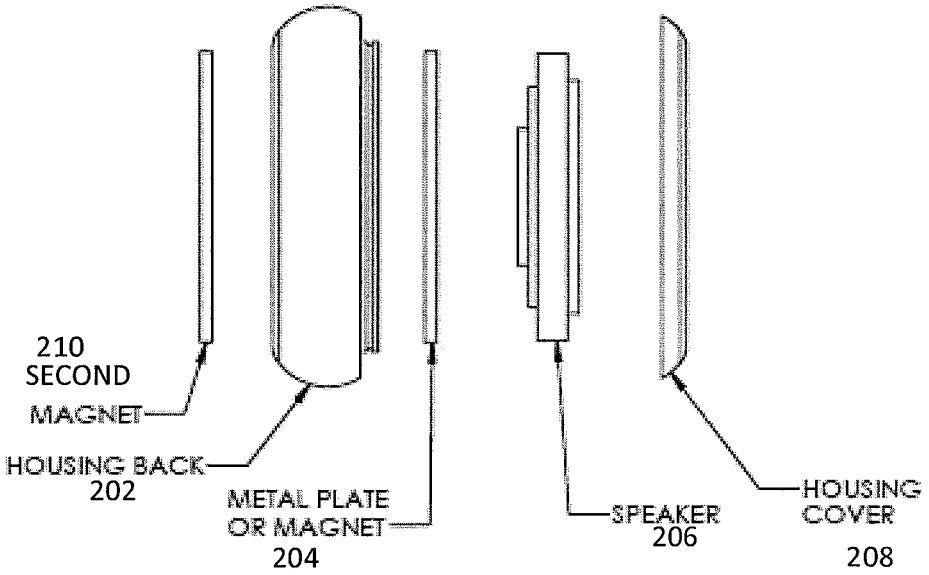
FIG. 2 is an exploded view of the speaker/housing assembly of FIG. 1.
Figure 3:
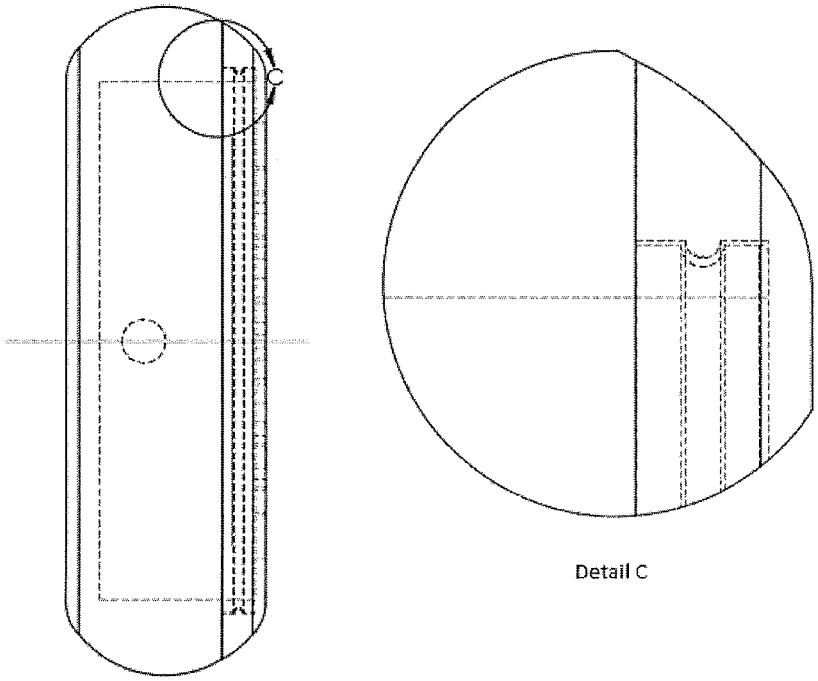
FIG. 3 shows a snap-fit connection attaching the housing cover to housing back in the embodiments depicted in FIGS. 1 and 2.

FIG. 2 is an exploded view of the speaker/housing assembly of FIG. 1. As shown, the speaker/housing assembly includes a housing back 202, a speaker 206, a metal plate or magnet 204 separate from any magnet of the speaker 206, and a housing cover 208. As shown in FIG. 3, the housing cover may snap-fit with the housing back in order to encapsulate the metallic plate or magnet and the speaker inside of the housing, although the housing cover may attach to the housing back in other ways, e.g., threading, glue, etc. The housing back and/or housing cover may include features to support the plate/magnet and/or the speaker, for example, to prevent the speaker from rotating within the housing, which could put strain on speaker wiring (not shown for convenience). When the speaker/housing assembly is placed on an item, particularly a non-metallic or non-magnetic item such as an article of clothing, a second magnet 210 (which is not an integral part of the speaker/housing assembly) may be used to secure the speaker/housing assembly to the item. In some cases, the magnet 204 may itself be sufficient to secure the speaker/housing assembly to a metallic or magnetic item. In some cases, a magnetic plate 204 may be used in or on the speaker/housing assembly, in which case the speaker/housing assembly may be secured to a magnetic surface or may be secured to a non-metallic or non-magnetic item using the magnet 210, which is not an integral part of the speaker/housing assembly.

Embodiments of the invention are not limited to any particular type of speaker. For example the speaker can be a cone speaker, a ribbon speaker, a piezoelectric horn speaker or other type of speaker. The casing form in addition is not limited to a simple multiple hole design, or a mesh screen design, but may include one or more structures in or on the casing that can directly target the sound to the user's ear, e.g., through a plastic funnel or trumpet. These embodiments, in order to be consistent with the claims on giving the user freedom of motion and being barely noticeable must be of the size and weight that they do not limit free range of motion or impose overbearing weight.

The material selection for the invention is not limited in any fashion. The housing would be typically made of plastic but other materials may be used. The magnets may include older steel based magnets as well as other forms of magnets such as rare earth element magnets.

The wiring of this device (not shown in the drawings for convenience) can be a multitude of different set ups. The primary wiring typically will be secured through a small gasket on the surface opposite of the sound emitting surface of the speaker. The wiring system can incorporate but is not limited to: a muting button for the headphones, a muting button for each headphone individually, volume control for the headphones and volume control for each headphone individually.

Typical embodiments will include two speaker/housing combinations with wiring to allow the speakers to be connected to an audio device, although other embodiments are possible, such as a single speaker/housing combination, or even more than two speaker/housing combinations (e.g., four, five, or six speaker/housing combinations, such as for quadrophonic sound, surround sound, etc.). Alternatively, the speakers may have a wireless communication interface, such as, for example, Bluetooth.

Figure 4:
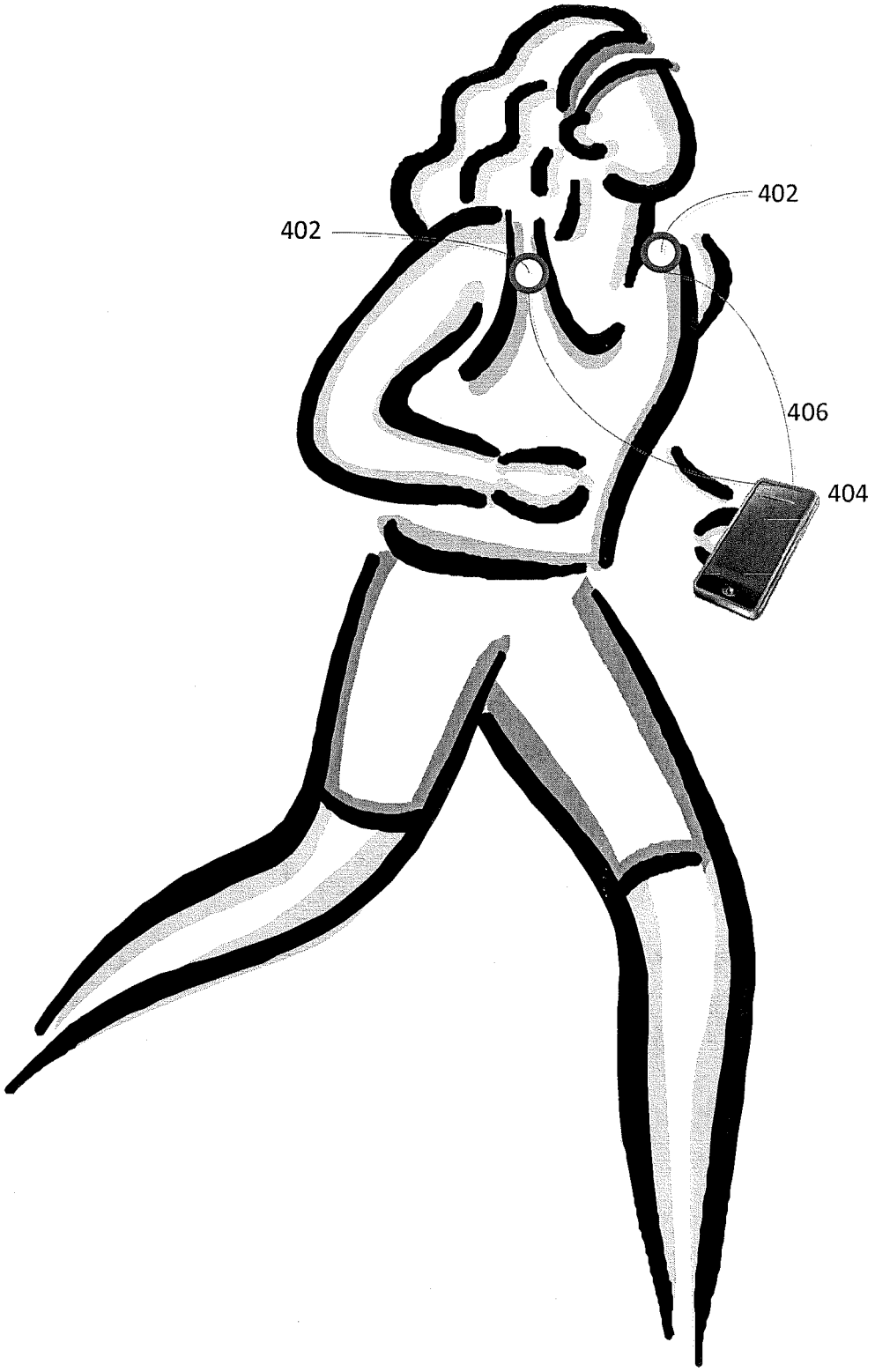
FIG. 4 is a schematic diagram depicting one use of a portable audio/speaker system of the type described herein.

FIG. 4 is a schematic diagram depicting one use of a portable audio/speaker system of the type described herein. In this example, a woman is running. She has a pair of speaker/housing assemblies 402 attached to the upper part of her shirt just under and facing toward the ears. She is carrying a portable music player 404, which is connected to the speaker/housing assemblies by wires 406.

Figure 5:
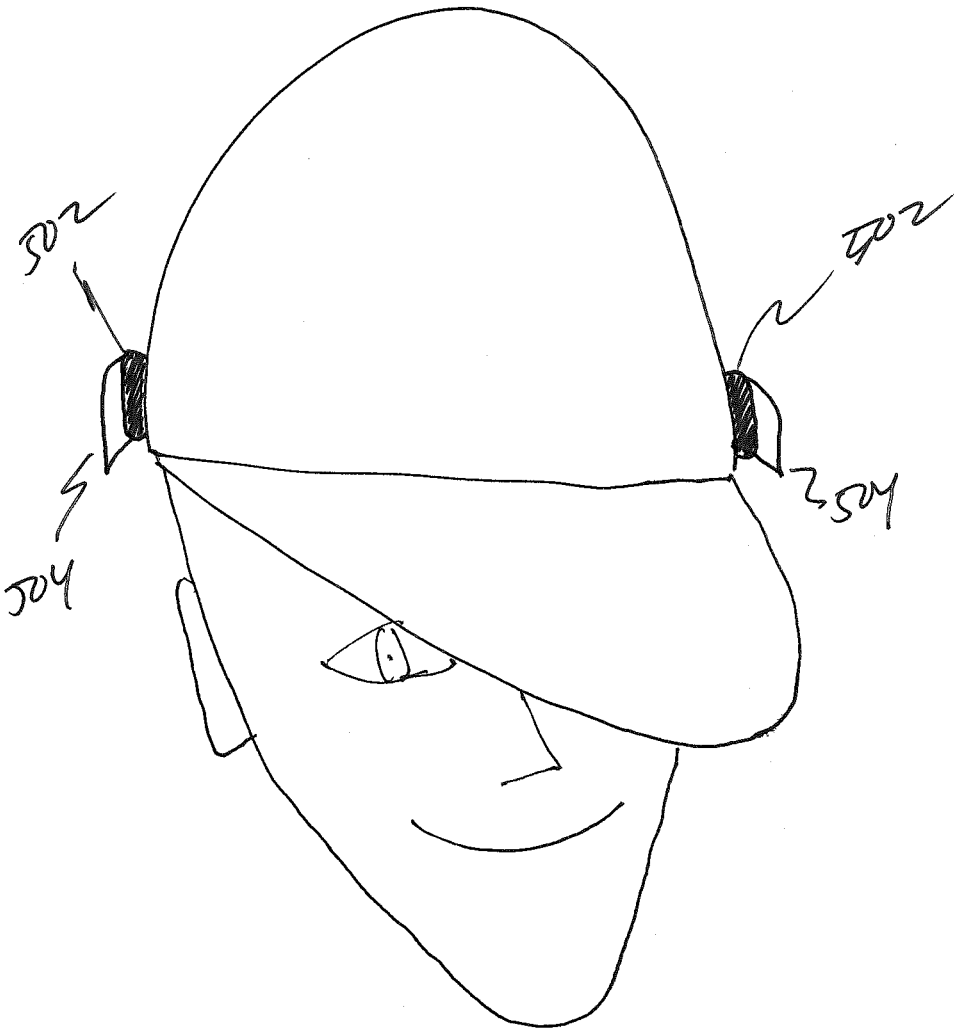
FIG. 5 is a schematic diagram depicting another use of a portable audio/speaker system of the type described herein in which each speaker/housing assembly includes a sound-directing structure attached or integral to the housing and configured to directly target sound from the speaker to a user's ear, in accordance with one exemplary embodiment.

FIG. 5 is a schematic diagram depicting another use of a portable audio/speaker system of the type described herein in which each speaker/housing assembly 502 includes a sound-directing structure 504 attached or integral to the housing and configured to directly target sound from the speaker to a user's ear. In this example, the speaker/housing assemblies 502 are attached to a hat, and the sound-directing structures 504 are configured to aim the sound downward toward the user's ears.

The present invention may be embodied in other specific forms without departing from the true scope of the invention, and numerous variations and modifications will be apparent to those skilled in the art based on the teachings herein. Any references to the "invention" are intended to refer to exemplary embodiments of the invention and should not be construed to refer to all embodiments of the invention unless the context otherwise requires. The described embodiments are to be considered in all respects only as illustrative and not restrictive.

What is claimed is:

1. A portable audio speaker system comprising at least one speaker/housing assembly, each speaker/housing assembly including a housing, a speaker disposed inside of the housing, and a magnet, separate from any magnet of the speaker, disposed inside of the housing, the magnet allowing the housing to be attached to a non-metallic or non-magnetic item.

2. A portable audio speaker system according to claim 1, further comprising a second magnet used to attach the housing to the item when the item is positioned between the housing magnet and the second magnet.

3. A portable audio speaker system according to claim 1, further comprising a metal plate used to attach the housing to the item when the item is positioned between the housing magnet and the metal plate.

4. A portable audio speaker system according to claim 1, wherein each speaker/housing assembly includes at least one of:

multiple holes; or a mesh screen.

5. A portable audio speaker system according to claim 1, wherein each speaker/housing assembly includes at least one structure configured to directly target sound from the speaker to a user's ear.

6. A portable audio speaker system according to claim 1, including a plurality of speaker/housing assemblies.

7. A portable audio speaker system according to claim 1, further comprising wiring to each speaker/housing assembly.

8. A portable audio speaker system according to claim 1, wherein at least one speaker/housing assembly includes a wireless communication interface.

9. A portable audio speaker system comprising at least one speaker/housing assembly, each speaker/housing assembly including a housing, a speaker disposed inside of the housing, and a metal plate disposed inside of the housing, the metal plate allowing the housing to be attached to a non-magnetic item using a magnet separate from the housing.

10. A portable audio speaker system according to claim 9, further comprising the magnet used to attach the housing to the item when the item is positioned between the housing and the magnet.

11. A portable audio speaker system according to claim 9, wherein each speaker/housing assembly includes at least one of:

multiple holes; or a mesh screen.

12. A portable audio speaker system according to claim 9, wherein each speaker/housing assembly includes at least one structure configured to directly target sound from the speaker to a user's ear.

13. A portable audio speaker system according to claim 9, including a plurality of speaker/housing assemblies.

14. A portable audio speaker system according to claim 9, further comprising wiring to each speaker/housing assembly.

15. A portable audio speaker system according to claim 9, wherein at least one speaker/housing assembly includes a wireless communication interface.

16. A method of attaching a portable audio speaker/housing assembly to a non-metallic or non-magnetic item, the speaker/housing assembly including a housing, a speaker disposed inside of the housing, and a first securing element, separate from any magnet of the speaker, disposed inside of the housing, the method comprising:

placing the speaker/housing assembly on one side of the item;

placing a second securing element on the other side of the item opposite the speaker/housing assembly, wherein one of the securing elements is a magnet and the other securing element is a magnet or a metal plate, and wherein the item is secured between the speaker/housing assembly and the second securing element.

* * * * *